US009558641B2

(12) United States Patent
Brasch et al.

(10) Patent No.: US 9,558,641 B2
(45) Date of Patent: Jan. 31, 2017

(54) SYSTEM AND METHOD FOR MONITORING A PERSON

(71) Applicant: J. Brasch Co., LLC, Lincoln, NE (US)

(72) Inventors: John J Brasch, Lincoln, NE (US); Perry B Howell, Lincoln, NE (US); Douglas E Ehlers, Lincoln, NE (US); Jason Nabb, Lincoln, NE (US); James R Leacock, Lincoln, NE (US); Gordon Smith, Jr., Lincoln, NE (US)

(73) Assignee: J. Brasch Co., Lincoln, NE (US)

( * ) Notice: Subject to any disclaimer, the term of this patent is extended or adjusted under 35 U.S.C. 154(b) by 0 days.

(21) Appl. No.: 14/574,670

(22) Filed: Dec. 18, 2014

(65) Prior Publication Data

US 2016/0196733 A1 Jul. 7, 2016

Related U.S. Application Data

(60) Provisional application No. 61/917,367, filed on Dec. 18, 2013, provisional application No. 61/977,667, filed on Apr. 10, 2014.

(51) Int. Cl.
*G08B 23/00* (2006.01)
*G08B 21/04* (2006.01)

(52) U.S. Cl.
CPC ..... *G08B 21/0407* (2013.01)

(58) Field of Classification Search
CPC ..... G04G 13/021; G08B 21/02; G08B 21/22; G08B 21/0461; G06F 19/3418
USPC ..... 340/531, 573.1, 573.4, 539.17
See application file for complete search history.

(56) References Cited

U.S. PATENT DOCUMENTS 8,723,677 B1 * 5/2014 Kiani ..... A61B 5/1115 340/573.1
9,226,696 B2 * 1/2016 Kiani ..... A61B 5/1115
2006/0017559 A1 * 1/2006 Albert ..... G04G 13/021 340/531
2007/0040692 A1 * 2/2007 Smith ..... A61B 5/1115 340/573.1
2007/0156031 A1 * 7/2007 Sullivan ..... G08B 21/02 600/300
2012/0025990 A1 * 2/2012 Tallent ..... G08B 21/0461 340/573.4
2012/0025992 A1 * 2/2012 Tallent ..... G08B 21/22 340/573.4
2013/0135160 A1 * 5/2013 Dixon ..... H01Q 1/44 343/720
2014/0104404 A1 * 4/2014 Locke ..... G08B 21/02 348/77
2014/0232556 A1 * 8/2014 Williams ..... H04Q 9/00 340/870.09

(Continued)

*Primary Examiner* — Hoi Lau
(74) *Attorney, Agent, or Firm* — Michael D. Eisenberg

(57) ABSTRACT

An apparatus is provided for monitoring a person. The apparatus is configured for identifying one or more undesirable conditions, by analyzing data from a sensor unit associated with the person's bed, the data being indicative of the person's presence in or absence from the bed. Upon identification of at least one undesirable condition, the apparatus emits a local alarm and transmits an alert signal to a remote apparatus, which is configured for notifying one or more responders about the undesirable condition. If one or more responders responds to the notification, or if the apparatus is reset locally, the local alarm is stopped.

21 Claims, 9 Drawing Sheets

(56) References Cited

U.S. PATENT DOCUMENTS

| | | | | |
|---|---|---|---|---|
| 2014/0333440 | A1* | 11/2014 | Kiani | A61B 5/1115 340/573.4 |
| 2015/0095054 | A1* | 4/2015 | Kaigler | G06F 19/3418 705/2 |
| 2015/0170494 | A1* | 6/2015 | Hsu | G06F 19/3418 340/539.17 |
| 2015/0254956 | A1* | 9/2015 | Shen | A61B 5/1115 340/573.1 |

* cited by examiner

400

SYSTEM AND METHOD FOR MONITORING A PERSON

CROSS-REFERENCE TO RELATED APPLICATIONS

The present application claims priority to U.S. Provisional Application Ser. No. 61/917,367 filed on Dec. 18, 2013 and U.S. Provisional Application Ser. No. 61/977,667 filed on Apr. 10, 2014, which are hereby incorporated herein by reference in their entirety.

BACKGROUND OF THE INVENTION

Caring for an elderly person is a difficult task. Leaving the elderly person alone for even a short time period may be worrisome to the caregiver. Different systems are available in the art for monitoring elderly people and keeping responders (such as family members, medical personnel, or hired caretakers) informed about the status of the monitored elderly people.

For example, BeClose (beclose.com) manufactures a monitoring system which includes a plurality of wireless sensors, a hub, and a server. The wireless sensors are placed around the house of the monitored person, and record different activities of the monitored person. The hub receives data from the sensors and transmits the data to the server, which is accessible to responders for monitoring the activities of the monitored person. The server is also configured for processing the data to identify one or more undesirable conditions, which may be indicative of an emergency. If at least one of the conditions is identified, the server notifies the responder via an email, an SMS, or a phone call.

BRIEF SUMMARY OF EMBODIMENTS OF THE INVENTION

The inventor has found that while the prior art provides the ability to remotely monitor a person, it lacks the ability to inform the monitored person that the responder(s) is(are) about to be notified, and stop the notification from being sent if there is no emergency. Moreover, in the prior art, in case of emergencies, the communication between the server and the responders is one-directional, and does not allow the responder to answer the notification and inform the server (and possibly other responders who have been notified) that the responder is taking care of the problem.

The present invention aims at correcting such deficiencies and providing a more complete monitoring system. In some embodiments, of the present invention, a monitoring apparatus/system is provided which is configured, inter alia, for enabling the monitored person to stop the sending of notifications (alarms) if no emergency arises, and for enabling the responders to answer a notification and inform the server and optionally other responders that the emergency is being taken care of.

Therefore, an aspect of some embodiments of the present invention relates to an apparatus for monitoring a person. In one embodiment, the apparatus includes a sensor port, a memory unit, a timer, a processor, a local linking unit, and a remote linking unit. The sensor port is configured for receiving first signals from a sensor associated with a bed of the person. The memory unit is configured for storing machine-readable instructions and a set of parameters used to determine one or more alert conditions related to the person's use of the bed. The timer is configured for measuring time. The processor is coupled to the sensor port, to the timer, and to the memory, and is configured for executing the machine-readable instructions that causes the apparatus to: (a) receive the first signals from the sensor via the sensor port and determine therefrom whether the person is in the bed or not in the bed; (b) determine time instances and time durations associated with the person being in the bed and being out of the bed based on the first signals and on time measurements by the timer; (c) compare the time instances and time durations to at least some of the parameters in the set of parameters to determine whether an alert condition of the one or more alert conditions has occurred; (d) generate an alert alarm signal if the alert condition has occurred; and (e) cancelling the alert alarm signal, in response to a cancel instruction. The local linking unit is configured for connecting to a local user interface, and communicating the alert alarm signal to the local user interface. The local user interface is configured for receiving the alert signal and for conveying a local alarm warning in proximity to the local user interface, and for receiving a cancel instruction from one or more of persons proximate to the apparatus to cancel the alert signal. The remote linking unit is configured for connecting to a remote system configured for receiving the alert signal and conveying a remote alarm alert to one or more remote communication devices associated with respective responders located remotely from the apparatus, and for receiving a first cancel instruction conveyed from the one or more responders to cancel the alert signal.

In a variant, prior to generating the alert alarm signal, the processor is configured for causing the apparatus to generate a pre-alert alarm signal if the alert condition has occurred, the pre-alert signal for notifying the persons proximate to the apparatus that an alert condition has occurred. The local linking unit is configured for receiving the pre-alert alarm signal and for conveying a pre-alert alarm warning in proximity to the local user interface, and for receiving a second cancel instruction conveyed from one of the persons proximate to the apparatus to cancel the pre-alert alarm signal. The processor is configured for cancelling the pre-alert alarm, in response to receiving the second cancel instruction. The processor is configured for causing the apparatus to generate the alert signal only if the alert condition persists for a predetermined time period without being cancelled.

In another variant, the apparatus further includes a transmitter coupled to the processor. The transmitter is configured to transmit the alert alarm signal to a local communication device physically separated from the apparatus and located within a space associated with the monitored person, causing the local communication device to convey an alert warning signal to persons located proximate to the local communication device to notify that one of the alert conditions has occurred.

In yet another variant, the apparatus further includes a transmitter configured to transmit the pre-alert alarm signal to the local communication device, causing the local communication device to convey a pre-alert warning to persons located proximate to the local communication device to notify that one of the alert conditions has occurred. The transmitter is configured for conveying the alert alarm signal to the local communication device only if the pre-alert alarm signal has not been cancelled within the predetermined time period.

In a further variant, the apparatus further includes a receiver configured to receive a cancellation signal from the local communication device for the apparatus to cancel the alert alarm signal. The processor is configured for cancelling the alert alarm signal upon reception of the cancellation signal.

In yet a further variant, the apparatus further includes a receiver configured to receive a cancellation signal from the local communication device for the apparatus to cancel the alert alarm signal and/or the pre-alert alarm signal. The processor is configured for cancelling the alert alarm signal and/or the pre-alert signal upon reception of the cancellation signal.

In some embodiments of the present invention, the one or more alert conditions comprise at least one of the following: the person is out of bed during a bedtime period specified in the set of parameters; the person is in bed after a wake-up time specified in the set of parameters; and the person has been out of bed during the bedtime period for a time interval greater than a predetermined time interval specified in the set of parameters.

In a variant, the machine-readable instructions further comprises instructions that cause the apparatus to generate a notification for transmission to the remote system, in response to receiving the cancel instruction, the notification for informing the remote system that the pre-alert alarm had been generated and then canceled. The remote linking unit may be further configured to transmit the notification.

In another variant, the remote system comprises at least one of a monitored call center and a server.

In yet another variant, the apparatus includes the local user interface, such that the local user interface is integral with the apparatus.

Another aspect of some embodiments of the present invention relates to a kit for monitoring a person, comprising the above-mentioned apparatus and the sensor.

Yet another aspect of some embodiments of the present invention relates to a system for monitoring a person and configured for operating in conjunction with a timer and a memory module configured for storing first data indicative of commands for an operation of the system. The system includes an analysis module, an alert module, and a reset module. The analysis module is configured for: (i) receiving second data from at least one sensor associated with the person's bed; (ii) processing the second data to determine a status relating to presence of the person in bed and/or an absence of the person from the bed, and to a time length of the person's presence and/or absence; (iii) using the first data and time from the timer to identify at least one undesirable condition relating to the status; (iv) if the at least one condition is true, generating a first control signal. The alert module is configured for: (a) receiving the first control signal; (b) responsive to the first control signal, generating an alert signal; (c) transmitting the alert signal to a local device associated with the person, for causing the local device to convey an alert warning to the person; (d) transmitting the alert signal to a remote system, configured for contacting at least one caretaker of the person and conveying the alert warning to the at least one caretaker. The reset module is in communication with the local device and with the remote system, and is configured for: (1) receiving a reset signal from the local device and/or from the remote system; (2) responsive to the reset signal, sending a third control signal to the alert module. The alert module is configured for receiving the reset signal and, in response to the alert signal, for instructing the local device to stop conveying the alert warning and the system device to stop contacting the at least one caretaker.

In a variant, the system includes a pre-alert module configured for: (a) preventing the first control signal to reach the alert module; (b) receiving the first control signal; (c) upon reception of the first control signal, generating a pre-alert signal for causing a local device associated with the person to convey a pre-alert warning to the person; (d) using the first data and the time from the timer to determine whether the pre-alert warning has been active for a time length greater than a grace period specified in the first data; and (e) generating a second control signal, if the pre-alert warning has been active for a time length greater than the grace period. The alert module is further configured for receiving the second control signal and for generating the alert signal in response to the second control signal.

Optionally, the pre-alert module is configured for receiving the reset signal from the reset module and, in response to the reset signal, for instructing the local device to stop conveying the pre-alert warning or the alert warning.

In another variant, the system further includes a switch module configured for being programmed by a user via the local device for selecting whether the first control signal is to be transmitted to the pre-alert module or to the alert module.

In yet another variant, the at least one undesirable condition comprises at least one of the following: the person is out of bed during a bedtime period specified in the first data; the person is in bed after a wake-up time specified in the first data; and the person has been out of bed during the bedtime period for a time interval greater than a predetermined time interval specified in the first data.

In a further variant, responsive to the reset signal, the alert module is configured for instructing the remote system to contact the at least one caretaker and to inform the caretaker that the alert signal has ceased.

In yet a further variant, upon receipt of the alert signal, the alert module is further configured for checking a connection between the alert module and the remote system. If the connection is successful, generating and transmitting the alert signal to the remote system. If the connection is not successful, transmitting an instruction signal to the local device to cause the local device to contact the at least one caretaker and conveying the alert warning to the at least one caretaker.

Optionally, if the connection is not successful, upon receipt of the reset signal, the alert module is configured for instructing the local device to stop conveying the alert warning and to stop contacting the at least one caretaker.

Optionally, responsive to the reset signal, the alert module is configured for instructing the local device to contact the at least one caretaker and to inform the caretaker that the alert signal has ceased.

A further aspect of some embodiments of the present invention relates to a system for monitoring a person. The system includes a local apparatus and a remote apparatus. The local apparatus is configured for: (a) receiving data from at least one sensor associated with the person's bed, and for using the data to identify at least one undesirable condition relating to a presence of the person on the bed and/or an absence of the person from the bed; (b) upon identification of the at least one undesirable condition, outputting an alert warning and prompting locally for an input, and generating an alert signal; (c) checking a connection with the remote apparatus; (d) if the connection with the remote device is successful, transmitting an alert signal to the remote apparatus; (e) if the connection with the remote device is not successful, transmitting the alert signal to at least one remote communication device associated with a respective predetermined responder. The remote apparatus is configured for: (a) receiving the alert signal; (b) upon reception of the alert signal, transmitting the alert signal to at least one remote communication device associated with a respective predetermined responder.

In a variant, after the identifying the at least one undesirable condition and prior to the generating of the alert warning, the local apparatus is configured for: outputting a pre-alert warning and prompting locally for an input; and if the input is not received within a predetermined length of time, outputting the alert warning and generating the alert signal.

In another variant, the local apparatus is connected to the remote apparatus via the internet.

In yet another variant, the local apparatus and the remote apparatus are configured for communicating with the at least one remote communication device via a cellular network.

In a further variant, the local apparatus and the remote apparatus are configured for generating the alert signal in form of an SMS or a voice message receivable by the at least one remote communication device.

Optionally, if the local apparatus receives a local input following the pre-alert warning, the local device is configured for stopping the output of the pre-alert warning.

In yet a further variant, if the local apparatus receives a local input, following the alert warning, the local apparatus is configured for stopping the output of the alert warning and for sending the remote apparatus a reset signal. Upon receipt of the reset signal, the remote apparatus is configured for ceasing to transmit the alert signal to the at least one remote communication device.

In a variant, if the local apparatus receives a local input, following the alert warning, the local apparatus is configured for stopping the output of the alert warning and for sending the remote apparatus a reset signal. In response to a reception of the reset signal, the remote apparatus is further configured for generating and transmitting a cancellation signal to the at least one remote communication device, to cause the at least one remote communication device to convey a message to the respective responder indicating that the alert has ceased.

In another variant, following the transmittal of the alert signal, the remote apparatus is configured for receiving an acknowledgement from the at least one remote communication device, and in response to the acknowledgement, the remote apparatus is configured for ceasing generation and transmittal of the alert signal and for generating and sending a reset signal to the local apparatus. Upon receipt of the reset signal, the local apparatus is configured for stopping the output of the alert warning.

In yet another variant, following transmittal of the alert signal by the local apparatus, the local apparatus is configured for receiving an acknowledgement from the at least one remote communication device, and in response to the acknowledgement, the local apparatus is configured for ceasing generation and transmittal of the alert signal to the at least one remote communication device.

In a further variant, the remote apparatus is a server or a call center.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
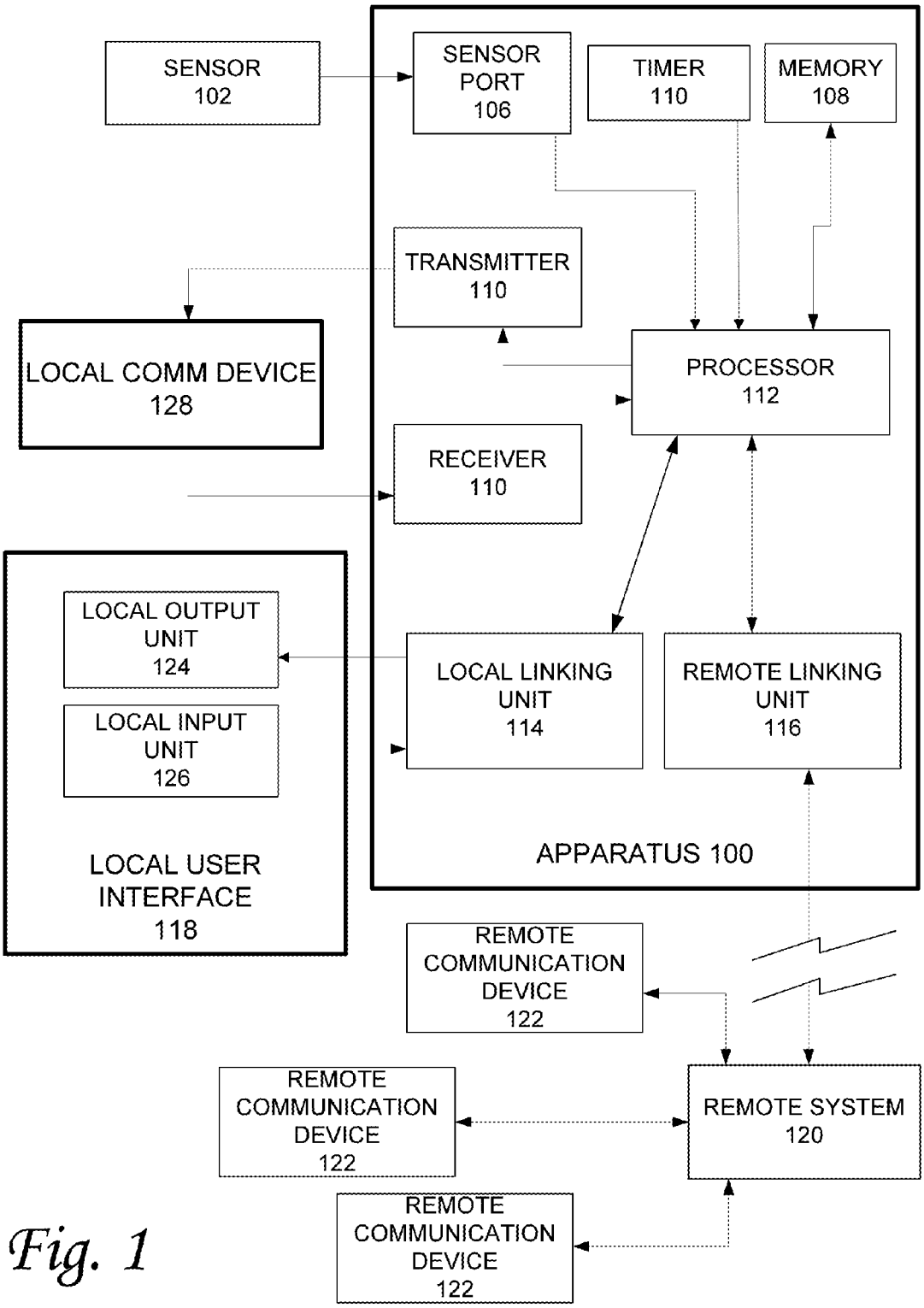
FIG. 1 is a block diagram illustrating an apparatus for monitoring a person, according to some embodiments of the present invention.

Referring now to the drawings, FIG. 1 is a block diagram illustrating a "local" apparatus 100 for monitoring a person, according to some embodiments of the present invention. The apparatus 100 is configured for being connected to one or more sensors 102 and with a remote system 120.

The apparatus 100 includes a sensor port 106, a memory unit 108, a timer 110, a processor 112, a local linking unit 114, and a remote linking unit 116. In one variant, the apparatus 100 includes and is integral with a local user interface 118. In another variant, the apparatus 100 is in wired or wireless communication with the local user interface 118.

The one or more sensors 102 are associated with a bed of the monitored person, and are configured for producing first signals indicative of the presence or absence of the person on the bed. The sensors may include, for example, a pressure sensor located on or under the mattress, configured for being activated or deactivated when pressure is apply thereupon. Optionally or additionally, the sensor includes a camera for monitoring the bed and an image processing unit configured for using the camera's images or feed for determining whether the person is or is not on the bed. The sensor may be any sensor that may be used for determining whether the person is in bed or not, and the apparatus 100 of the present invention may be configured for receiving data signals from one or more of any kinds of sensors.

The apparatus 100 is connected to the one or more sensors 102 via the sensor port 106. The connection may be wired or wireless (e.g. Bluetooth, WiFi, or any other kind of wireless connection). The sensor port 106 is configured for receiving the first signals from the one or more sensors 102, and for providing the first signals to the processor 112.

The processor 112 comprises a microprocessor, microcontroller, custom ASIC, and/or discreet circuitry selected on the basis of power consumption, size, processing speed, memory capacity, and other factors for performing all of the functionality of the apparatus 100.

The timer 110 is configured for measuring time, and may be integral with the processor 112 as a function performed by processor 112 in accordance with machine-readable instructions stored in memory unit 108, or may comprise a distinct and separate hardware and/or firmware element, coupled to the processor.

The memory unit 108 comprises one or more a non-volatile data storage units, such as one or more hard disks, SD cards, disk-on-key drives, Flash memory, SRAM, or any other data storage unit. The memory unit 108 is configured for storing machine-readable instructions, and a set of parameters used to determine one or more alert conditions related to the person's use of the bed. The alert conditions define situations that may indicate an emergency. These situations are functions of the absence or presence of the monitored person on the bed at predetermined times and/or during predetermined time intervals. For example, one alert condition may correspond to a situation in which the monitored person is in bed after a predetermined wake-up time. This situation is unusual and may be indicative of the fact that the monitored person is not able to get out of bed—which is a potential emergency.

The processor 112 receives the first signals, is in communication with the timer and the memory unit, and is configured to process the first signals and determine whether an emergency condition exists, according to a comparison of the first signals with the parameters, such as a time duration, expected bed times, wake times, exception times, etc., stored in the memory unit 108. In some embodiments of the present invention, the processor may also provide other information, such as a current time that the condition occurred, a current status indicative of presence or absence in bed, and a time interval since the status was last changed. After determining a current condition of the monitored person, the processor 112 then compares the current condition with alert conditions stored in memory unit 108, to determine whether the current condition is an alert condition. In other embodiments of the present invention, the processor 112 analyzes the first signal according to a method stored in the memory unit 108, to determine whether an alert conditions is fulfilled. The latter embodiments are described in detail in the description of FIGS. 4, 5, and 11. The processor may include one or more central processing units used in computing.

If the processor determines that an alert condition exists, the processor generates an alarm signal. The alarm signal is provided to the remote linking unit 116, which comprises a port configured for communicating with a remote system 120, such as a server and/or a call center. The remote system 120 is configured for receiving the alarm signal, and in response to the alarm signal, conveying a remote alarm alert to one or more remote communication devices 122 (such as telephones, and/or tablets) associated with responders, such as medical personnel, or friends or family of the monitored person. The remote system 120 is also configured for receiving a response from the remote communication device(s), and responsive to this, generating a cancel instruction that is sent to the remote linking unit 116. The remote linking unit 116 provides the cancel signal to the processor 112, and the processor 112 cancels the alarm signal. In this manner, if a potential emergency condition of the monitored person is detected by the apparatus 100, one or more responders are informed of the potential emergency. Moreover, one of the responders can respond to the remote alarm alert in order to the take the responsibility to handle the emergency. Responsive to this response, the alarm signal is cancelled by processor 112. Optionally, when a response is sent to the remote system 120 from a remote communication device 122, the remote system 120 is configured for sending a message to the other remote communication devices 122, to inform them that one responder has taken responsibility to handle the emergency.

The alert alarm signal is also sent to the local user interface 118 (which may or may not be integral with the apparatus 100) via the local linking unit 114. The local user interface is located close to the bed of the monitored person, and enables the monitored person to stop an alarm. The local user interface includes a local output unit 124 and a local input unit 126. The local output unit is configured for receiving the alert alarm signal, and for conveying a local alarm (or a local alarm warning) in proximity of the local user interface. The local alarm output unit may include speaker, a display, lights, and/or haptic devices. In this manner, the warning may be conveyed as a sound, an image or text, as a light which may be on or blinking, and/or by activating the haptic device (which may vibrate to convey the warning, for example).

The local input unit 126 is configured for receiving an input from a person proximate to the local communication device. The input may be an instruction to cease the alarm, either because no emergency has occurred or because a responder is located near the monitored person and is handling the emergency. The instruction is converted to a cancel signal, which is transmitted by the local input unit 126 to the processor 112. Responsive to the cancel signal, the processor is configured for instructing the local output unit 126 to stop conveying the alarm alert signal, and for transmitting the cancel signal to the remote system 120, to enable the remote system 120 to inform responders that the alarm has ended. If the cancel signal comes from a remote communication device 122, the cancel signal is received by the processor, which is configured for instructing the local output unit 124 to stop conveying the alarm alert.

The local input unit 126 may include one or more of a touchscreen, a keyboard, a keypad, a button, an accelerometer, and a microphone for voice recognition. In some embodiments of the present invention, the local input unit and the local output unit are combined together as a touchscreen.

According to some embodiments of the present invention, the apparatus 100 is connected by wire or wirelessly to a local communication device 128. The local communication device is an electronic device, such as a cell phone, a tablet, or any portable electronic device, which is configured for receiving the alert signal from the processor and conveying an alarm to the user, in response to the alert signal. The local communication device 128 is further configured for receiving an input by a user, and for generating a cancel signal in response to the input signal. The local communication device 128 enables the user (which may be the monitored person or any responder with access to the local communication device) to cancel an alarm, even when the user is not near the apparatus 100.

As was the case with the local output unit 124, the local communication device 128 may include speaker, a display, lights, and/or haptic devices. In this manner, the alarm/warning may be conveyed as a sound, an image or text, as a light which may be on or blinking, and/or by activating the haptic device (which may vibrate to convey the warning, for example). Similarly, as was the case with the local input unit 126, the local communication device 128 may include one or more of a touchscreen, a keyboard, a keypad, a button, an accelerometer, and a microphone for voice recognition.

It should be noted, that according to some embodiments of the present invention, before an alert signal is generated, the processor generates a pre-alert signal in response to when an alert condition is determined by processor 112. The pre-alert signal is transmitted to the local user interface and to the local communication device, if present prior to an alert alarm signal. Responsive to the pre-alert signal, the local user interface (and the local communication device, if present) convey a pre-alert alarm, to inform the monitored person or any person in proximity of the monitored person (e.g., in the same house) that the apparatus 100 has detected an alert condition. If the alert condition does not reflect an emergency (e.g., the monitored person is out of bed and watching television at the predetermined bedtime), or if a person near the monitored person can handle the emergency, the monitored person or the person who is in proximity of the monitored person can instruct the apparatus 100 to cancel the pre-alert signal, cease to convey a local pre-alert alarm, and stop an alert alarm signal from being generated, via an input to the local user interface or the local communication unit. If the apparatus 100 does not receive a cancel signal within a predetermined time interval, the processor generates the alert alarm signal, which is provided to the one or more remote communication devices, the local user interface, and/or the local communication device, if present. In this manner, responders are not contacted for non-emergency conditions, or for emergency conditions that are already being handled.

In some embodiments of the present invention, the local output unit includes a display, which is configured for being dimmed during a predetermined time period each day, to provide a friendlier environment for sleep. Alternatively or additionally, the display has a "sleep-time mode" in which the display's colors are inverted. Thus, the white background becomes black and the black text is changed to a shade of gray.

In some embodiments of the present invention, the "sleep-time mode" is only activated when some or all of the following conditions are met: (i) the current time is between sleep hours (after bedtime but before wake time); (ii) the sensing units indicated the presence of someone in the bed (for example, a pressure pad senses a minimal pressure, indicating someone is in the bed); (iii) the input unit has not been interacted with for a predetermined length of time (e.g., 30 seconds, 45 seconds, 60 seconds). In this manner, the display is bright when the monitored person is up and possibly moving around the room, but is dimmed (by simple dimming and/or by inverting colors) when the person is in bed to provide a more friendly environment for sleep.

In some embodiments of the present invention, the local input unit 124 includes an adaptive snooze. To accommodate early risers the adaptive snooze in the form of a button, which, when pressed, sends a signal to processor 112, which causes processor 112 to notify the remote system 120 that the monitored person is up for the day. In response, the remote system 120 sends a message, such as an SMS message, email, Facebook alert, etc., to one or more caregivers, stating that the monitored person is up for the day. The button may be a physical button or a virtual button on a touchscreen. The button may also comprise a wearable device capable of sensing when a person is in an upright position, and for wirelessly transmitting a status of the person, i.e., "upright" or "lying down". Optionally, if the button is on a touchscreen, the button only appears if the monitored person has risen from bed prior to his/her scheduled wake time, but is still relatively close to the programmed wake time.

In a variant, the adaptive snooze is configured to accommodate a monitored person who wakes up for an extended period in the night. The adaptive snooze may be in the form of a screen that prompts the monitored person to add additional time to the snooze. This allows the monitored person to be away from bed longer in the middle of the night in order to read or watch TV without triggering either a pre-alert alarm signal and/or an alarm alert signal. This feature may present a risk that a fall might go undetected for an increased length of time. Because of this greater risk, this form of adaptive snooze may be made available only if the monitored person and/or the caregivers/responders opt in.

In a variant, the apparatus 100 is programmable and is configured to report to the remote system(s) 120 with configuration information, when a change in configuration has occurred. Optionally, configuration changes can be pushed from the remote system 120 to the apparatus 100.

This can be done by providing a web portal in direct communication with the remote system 120. The portal provides a user with the ability to remotely update his/her monitoring system with new contacts, bedtimes, grace periods, etc.

Optionally, the web portal is at least partially accessible to selected people, such as family members or caretakers. Those with access to the web portal are able to add upcoming events or appointments which they would like to remind the monitored person of. When the apparatus 100 contacts the remote system 120, these events or appointments are downloaded by the apparatus 100 and saved until the appropriate time. Once the appointment nears, the local output unit 124 and/or local communication device 128 displays a reminder.

To confirm whether communication between the remote system 120 and the local apparatus 100 is operable, the local apparatus 100 generates a check-in message, such as one or more IP packets, and instructs the remote linking unit 116 to send the packet to the remote system 120, in one embodiment, at a predetermined frequency (e.g. several times an hour). Optionally, the remote system 120 aggregates this data and, if a local apparatus 100 hasn't checked-in for a predetermined time length, the remote system 120 notifies at least one responder via remote communication device 122 that something might be wrong.

In some embodiments of the present invention, the local apparatus 100 queries the remote system 120 (e.g. server) at a predetermined frequency (e.g., once per day) to determine if there is a new firmware update available. If there is an update, the local apparatus may download the update file, verify that the file's contents are valid, and apply the update during a non-operational period of the day. Once the update is complete, the local apparatus 100 may reboot and comes back up to normal operating conditions. Optionally, the update and reboot occur without the knowledge of the user (monitored person or a caregiver thereof).

Figure 2:
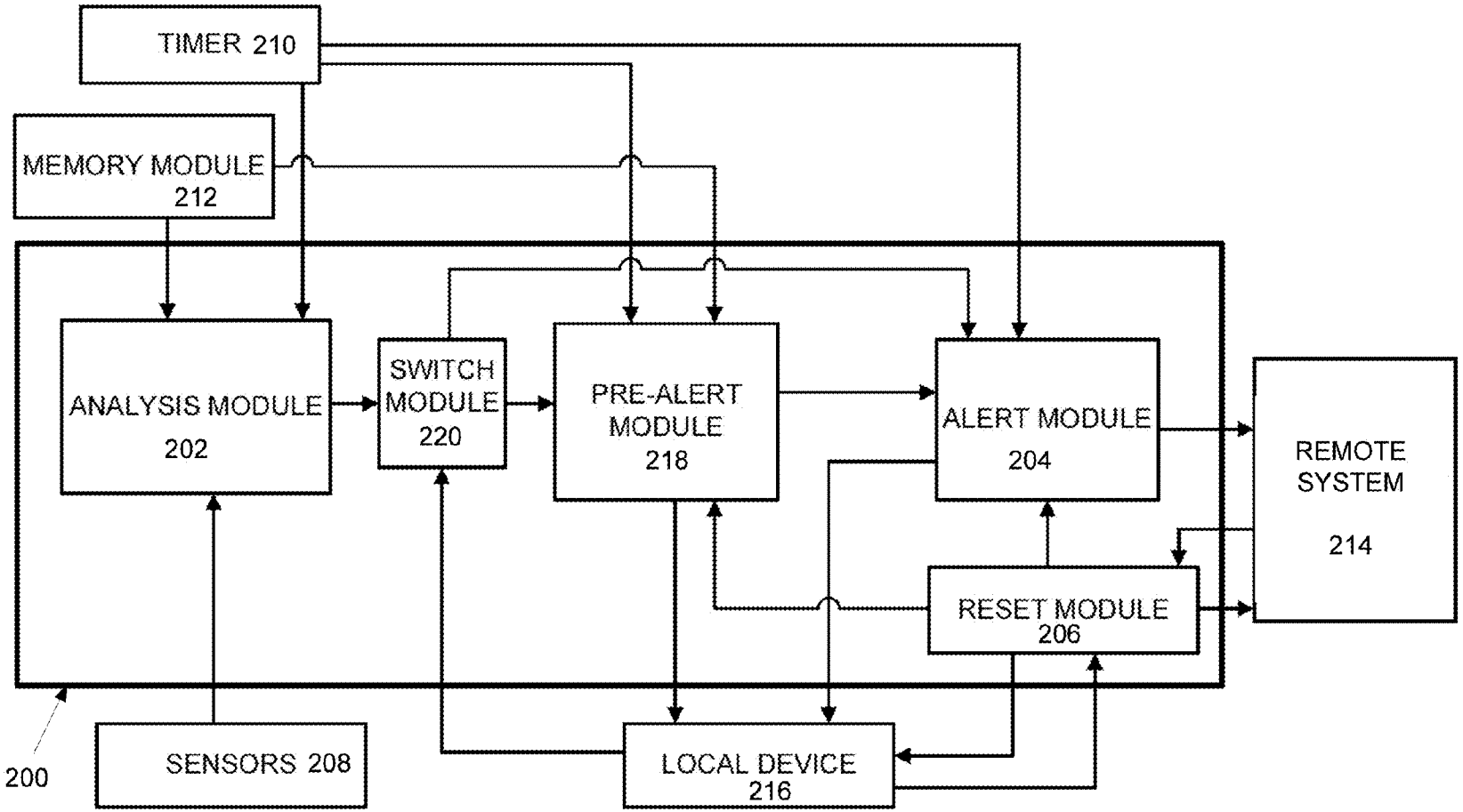
FIG. 2 is a block diagram illustrating a software and/or hardware system for monitoring a person, according to some embodiments of the present invention.

FIG. 2 is a block diagram illustrating a software and/or hardware system 200 for monitoring a person, according to some embodiments of the present invention. The system 200 includes a plurality of modules. Each module may be implemented as a hardware and/or software element of a data processing and analyzing utility configured for running a respective process on a processor, such as a microprocessor, microcontroller, custom ASIC, and/or discreet electronic components, suitable to perform the operations of the system.

The system 200 includes an analysis module 202, an alert module 204, and a reset module 206. The analysis module is configured for receiving sensor data from one or more sensors 208, a time measurement from a timer 210, and first data indicative of commands for an operation of the system from a memory module 212 in which the first data is stored. Similarly, to FIG. 1, the one or more sensors 208 are associated with the bed of a person to be monitored, and generate sensor data indicative of the person's presence or absence from the bed. Also, the first data in the memory module includes information about alert conditions. The analysis module uses the sensor data, the first data, and the time data to determine whether an undesirable condition is present, relating to the person's presence of the person in bed and/or an absence of the person from the bed, and to a time length of the person's presence and/or absence.

If the undesirable condition is identified, for example by comparing a length of time that a monitored person is out of bed to a predetermined, allowed time period, the analysis module 202 outputs a first control signal. The first control signal is transmitted to the alert module 204, which is configured for generating an alert signal in response to the first control signal. The alert module transmits the alert signal to a remote system 214 and optionally to a local device 216. The remote system 214 is similar to the remote system 120 of FIG. 1, and is in communication with one or more remote communication devices associated with responders. The local device 216 is similar to the local user interface 118 and optionally to the local communication device 128 of FIG. 1. The remote communication devices and the local device are configured for conveying an alert warning.

The reset module 206 is configured for receiving a reset signal from the local device 216 and/or from the remote system 214, and for generating a reset control signal in response to the reset signal. The reset signal is transmitted to the alert module 204, which in turn instructs the local device 216 to stop conveying the alert warning and the system device 120 to stop contacting the at least one caretaker, and/or to send a signal to the caretaker indicating that the condition associated with the alert has been taken care of.

Optionally, the system 200 includes a pre-alert module 218. The pre-alert module 218 receives the first control signal from the analysis module 202, while preventing the first control signal from reaching and activating the alert module. In response to the first control signal, the pre-alert module generates a pre-alert signal and transmits the pre-alert signal to the local device 216. Upon reception of the pre-alert signal, the local device is configured for conveying a pre-alert warning locally (e.g., to the monitored person and/or to any other persons in the vicinity of the monitored person—e.g., in the same house).

The pre-alert module is further configured for receiving the first data from the memory module 212 and time measurement from the timer 210 to determine whether the local device has been in the pre-alert mode for a time interval greater than a predetermined grace period specified in the first data. If this is the case, the pre-alert module 218, is configured for generating a second control signal and transmitting the second control signal to the alert module 204. In response to the second control signal, the alert module is configured for being activated and performing the process described above.

In some embodiments of the present invention, the pre-alert module 218 is configured for receiving the reset signal from the reset module 206 and, in response to the reset signal, for instructing the local device to stop conveying the pre-alert warning.

Optionally, the system 200 includes a switch module 220, which is programmable via the local device 206. The switch module 220 is configured for receiving the first control signal from the analysis module 202, and for transmitting the first alert signal to the alert module 204 or to the pre-alert module 218, according to its programming. The switch 220 enables a user to decide a priori whether the identification of an undesirable condition should activate the pre-alarm module (thereby enabling the monitored person to reset the system before responders are contacted), or whether to activate directly the alarm module (thereby informing remote responders about the identification of the undesirable condition).

Optionally, the undesirable condition includes one or more of the following conditions: (i) the person is out of bed during a bedtime period specified in the first data; (ii) the person is in bed after a wake-up time specified in the first data; and (iii) the person has been out of bed during the bedtime period for a time interval greater than a predetermined time interval specified in the first data.

In some embodiments of the present invention, the alert module is configured for instructing the remote system 214 to contact the one or more caretakers and to inform them that the alert signal has ceased, such as in the case where the a local user cancels the alert signal via local device 216. In another embodiment, one of several caretakers contacts remote system 214 to indicate that the caretaker will take care of the problem, and remote system 214 contacts the other caretakers, informing them that one of the caretakers is taking care of the problem. In this manner, once a responder has taken the responsibility to check on the monitored person, the other responders are informed of this fact.

Optionally, the local device 216 can be set to communicate with the remote devices, such as smart phones, tablets, or computers in communication with remote system 214. In such an embodiment, the alert module is configured for checking its connection with the remote system 214. If the connection is successful, the alert module sends an alert alarm signal the remote system 214, to cause the remote system 214 to contact one or more remote devices. If the connection is unsuccessful, the alert module is configured to transmit an instruction signal to the local device 216, to instruct the local device 216 to contact the remote devices directly, such as by cellular data, Wi-Fi, or some other communication technology that may be included in local device 216. Still in the instance that the connection between the alert module and the remote system is not successful, in a variant, the alert module is configured for instructing the local device 216 to stop contacting responders, and optionally to inform responders that the alert signal has ceased, in response to a reset signal.

Figure 3:
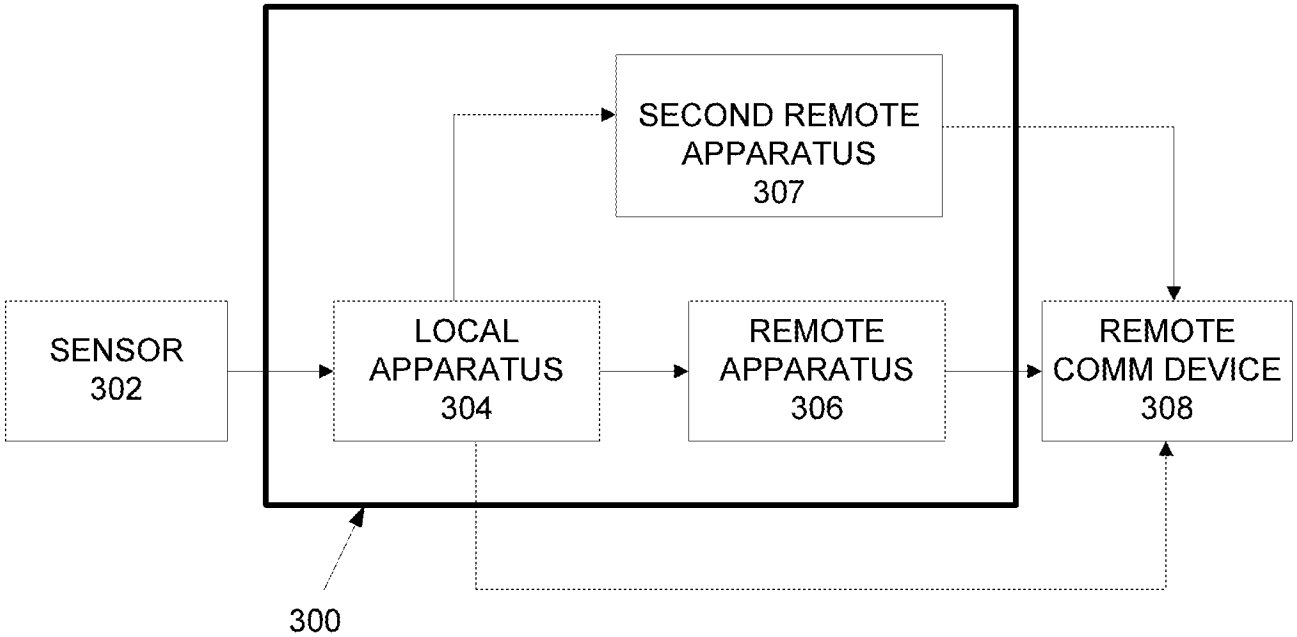
FIG. 3 is a block diagram illustrating a system of the present invention, which enables communication with a responder's communication device via two different paths.

FIG. 3 is a block diagram illustrating one embodiment of a system of the present invention, which enables communication with a responder's communication device via two different paths.

According to some embodiments of the present invention, a system 300 is provided for monitoring a person. The system includes a local apparatus 304 and a remote apparatus 306. The local apparatus 304 is similar to the apparatus 100 of FIG. 1. The remote apparatus 306 is similar to the remote system 120 of FIG. 1, and may include a server or a call center. The local apparatus 304 receives signals from the sensor(s) 302 and is configured for determining whether an undesirable condition is occurring with respect to a monitored person's use of a bed, as explained in the embodiments above. If an undesirable condition occurs, the local apparatus 304 checks its connection with the remote apparatus 306. If the connection is successful, the local apparatus transmits an alert signal to the remote apparatus 306. Responsive to the alert signal, the remote apparatus 306 contacts one or more remote communication devices associated with respective responders, such as cellular telephones, tablet computers, etc., to convey a warning. The warning may be in the form of an SMS message, email, or a voice message. In the connection is not successful, the local apparatus 304 contacts the one or more responders directly.

In one embodiment, the local apparatus 304 and remote apparatus 306 are connected to each other via the Internet. In another embodiment, contact between the local apparatus 304 or the remote apparatus 306 with one or more remote communication devices is via a phone network, such as a cellular network, or a wide-area network, such as the Internet.

Optionally, the local apparatus 304 is configured for receiving a reset instruction/signal from the one or more remote communication devices 308 and for conveying the reset signal to the remote apparatus 306. In response to the reset signal, the local apparatus 304 is configured for stopping the conveying of a local warning, and optionally to stop sending alert signals to the remote communication devices 308. In response to the reset signal, the remote apparatus 306 is configured for ceasing to send alert signals to the remote communication devices 308.

Optionally, the remote apparatus 306 is configured for receiving a reset instruction/signal from the one or more remote communication devices 308 and for conveying the reset signal to the local apparatus 304. In response to the reset signal, the local apparatus is configured for stopping the conveying of a local warning. In response to the reset signal, the remote apparatus is configured for ceasing to send alert signals to the remote communication devices 308.

In some embodiments of the present invention, in response to the alert signal, the remote and the local apparatuses are configured for transmitting a cancellation signal to the at least one remote communication device 308. The cancellation signal causes the at least one remote communication device 308 to convey a message to the respective responder indicating that the alert has ceased.

In a variant, the local device 304 is configured for conveying a local pre-alert warning when an undesirable condition has been identified, for example, an audible alert. If no input has been received by the local device from a person within proximity to the local device 304 within a predetermined time interval, the local device 304 is configured to generate the alert signal.

In some embodiments of the present invention, the system 300 includes a second remote apparatus 307. In this manner, if the connection between the local apparatus 304 and the first remote apparatus 306 fails, the local apparatus can send the alert signal to the second remote apparatus, and the second remote apparatus can relay the alert signal to the remote communication device(s) 308. For example, the first remote apparatus 306 may be a server, while the second remote apparatus 307 may be a call center.

Optionally, the sensor(s) 302 is (are) part of the system 300.

Figure 4:
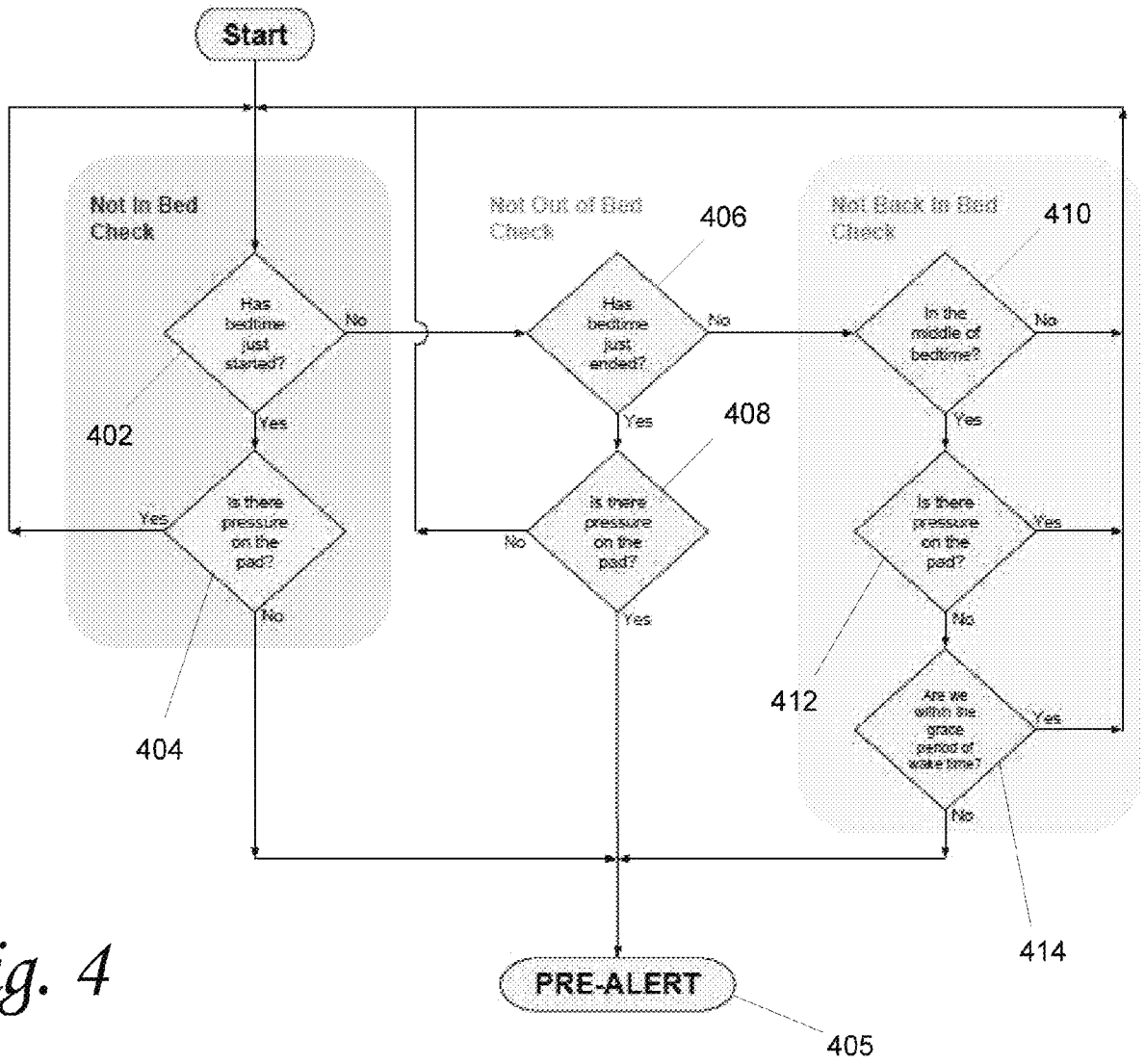
FIG. 4 is a flowchart illustrating a method for generating a pre-alert signal indicative of a possible emergency, according to some embodiments of the present invention.

FIG. 4 is a flowchart 400 illustrating a method for generating a pre-alert signal indicative of a possible emergency, according to some embodiments of the present invention.

In some embodiments of the present invention, the processor 112 of FIG. 1 and the analysis module 202 of FIG. 2 perform the following functions: a not-in-bed check, a not-out-of-bed check, and a not-back-in-bed check. The not-in-bed check determines whether the monitored person is in bed just after a predetermined start of a bedtime period. The not-out-of-bed check determines whether the monitored person is still in bed just after a predetermined end of the bedtime period. The not-back-in-bed check determines whether the monitored person is in bed during the bedtime period, while allowing the monitored person to leave the bed for a certain grace time interval, for example to use the bathroom. Some or all of these predetermined times may be programmable to a user of local user interface 118, local communication device 128, and/or remote communication device 122.

At 402, the time is checked from timer 110 and the data from the memory module 108 or 212 (of FIG. 1 and FIG. 2, respectively) is used by processor 112 to determine whether the bedtime period has just started. If the bedtime period has just started, the monitored person is supposed to be in bed, and the not-in-bed check is performed by processor 112. Thus, at 404 the data received from the sensors is used by processor 112 to determine whether the monitored person is in bed, for example by checking if there is pressure on the pressure pad located on or under the mattress. If the monitored person is in bed, it is safe to assume that the monitored person does not need help. Thus a loop is effected back to the beginning of the process operation. If the monitored person is not in bed, there is a chance that the monitored person could not reach the bed and may need assistance. Thus, at 405, processor 112 generates a pre-alert signal and sends the pre-alert signal to the local output unit, e.g., local user interface 118 and/or local communication device 128.

If the bedtime period has not just started, a check is made at 406 by processor 112 to determine whether the bedtime period has just ended. If the bedtime period has just ended, the monitored person is not supposed to be in bed any longer, and the not-out-of-bed check is performed by processor 112. Thus, data received from the sensors is used at 408 to determine whether the person is in bed. If the monitored person is not in bed, it is safe to assume that the monitored person has followed his/her usual schedule and is not in need of assistance. Thus loop is executed back to the beginning of the process. If the monitored person is still in bed, a deviation from the schedule is detected, and the monitored person may not be in a condition to leave the bed. Thus, processor 112 generates a pre-alert signal at 405, and sends the pre-alert signal to the local output unit, e.g., local user interface 118 and/or local communication device 128.

If the bedtime period has not just started or not just ended, a check is made at 410 by processor 112 to determine whether the current time is during the bedtime period by comparing the time from timer 110 to the bedtime period. If this is not the case, the loop is executed back to the start of the process. If the current time is within the bedtime period, a check is made at 412 to determine whether the monitored person is in bed, by processor 112 evaluating the data from the sensor(s) 102/208/302. If the monitored person is in bed, the monitored person is following his/her usual schedule and it is safe to assume that the monitored person does not need help. Thus, a loop is executed back to the beginning of the process. If the monitored person is not in bed, processor 112 determines the length of time that the person has been out of bed. This is because, the monitored person may get out of bed in the middle of the bedtime period to go to the bathroom or get a drink of water. Processor 112 determines a time that the person was determined to be not in bed, and monitors for when the person returns to the bed 414. If the length of time in which the monitored person is out of bed does not exceed the predetermined grace time interval, the monitored person may be safe and may have voluntarily left the bed. Thus, a loop is executed back to the start of the process. However, if the person does not return to the bed within the predetermined grace time interval, as determined by sensor data and timer 110, the monitored person may have encountered a difficulty and may be in need of assistance. Thus, processor 112 generates a pre-alert signal at 405 and the pre-alert signal is sent to the local output unit.

Optionally, the primary power source of the apparatus 100 of FIG. 1 is an electrical plug into mains power, and the apparatus 100 also contains an internal battery backup which allows the apparatus to continue operating during a power interruption. In some embodiments of the present invention, the apparatus continually monitors the power source and if the power is interrupted, the control unit generates a pre-alert signal.

Figure 5:
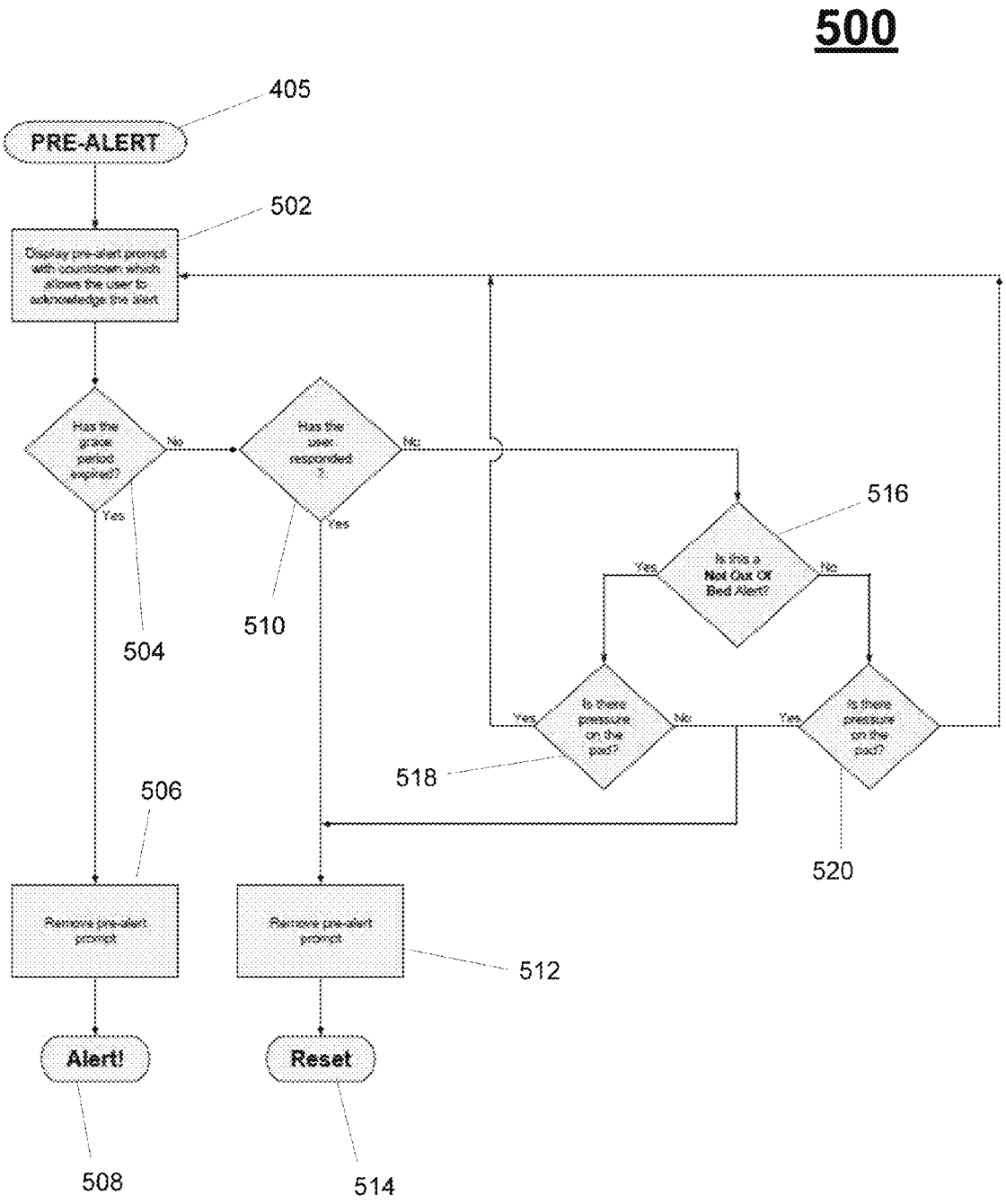
FIG. 5 is a flowchart illustrating a method for determining whether the pre-alert signal is indicative of an actual emergency, according to some embodiments of the present invention.

FIG. 5 is a flowchart 500 illustrating a method for determining whether the pre-alert signal is indicative of an actual emergency, according to some embodiments of the present invention;

A pre-alert signal was generated at 405, as the monitored person has departed from his/her usual schedule or as a consequence of a power failure. This, however, may or may not indicate a state of emergency. It is possible that the power failure is short, or that the monitored person has decided to stay up longer than usual, sleep longer than usual, or stay out of bed longer than usual during the bedtime period. Thus, after the pre-alert signal is generated and a pre-alert warning is emitted by the local output unit at 502, the monitored person can respond to the pre-alert warning to indicate that he/she is not in need of assistance.

After the pre-alert signal is generated by the control unit and sent to the local output unit, the local output unit issues the pre-alert warning, for example via a sound and/or an image on a display. The image on the display may include a countdown, showing the time left before an alert signal is sent to the remote system.

A check at 504 is made by processor 112 to determine whether a grace period for the monitored person's response, or a grace period within which the power is restored (e.g., 30 seconds, 1 minute, 2 minutes, etc.) has expired. If either of the grace periods has expired, it is assumed that the power failure may affect the operation of the monitoring system or that monitored person encountered a difficulty that prevented him/her from reaching the local input unit and signal that he/she is not in need of assistance. Thus, an alert signal is generated at 508 by processor 112, and sent to the remote system to alert responders of a potential emergency situation.

In the case of the power failure, if the grace period has not yet expired, the check to determine whether the grace period has expired may be performed repeatedly by processor 112, until either the power is restored or the grace period has expired (whichever occurs earlier). If the power is restored within the grace period, the system may be reset. If the grace period has expired, the alert signal may be generated.

If the pre-alert signal was generated in response to a need of assistance of the monitored person (in response to the "not in bed", "not out of bed" and "not back in bed" checks), a check is made at 510 by processor 112 to determine whether the monitored person has responded to the pre-alert warning. The response may be effected, for example, by pressing a key on a keyboard, a virtual button on a touch screen, or a button of the local input unit 124 or on the local communication device 128 in communication with the apparatus 100 of FIG. 1. If a response was detected, the pre-alert warning is turned off, and the system is reset by processor 112 at 514.

If no response has been received, a check is made at 516 by processor 112 to determine if the pre-alert was a not-out-of-bed alert. If the pre-alert was a not-out-of-bed alert, a check is made at 518 by processor 112 to determine whether the monitored person is still in bed. If the monitored person is in bed, as determined by processor 112 using data from sensor(s) 102/208/302, the monitored person may simply have been slow to wake up, and a loop is executed back to emitting the pre-alert warning. If the monitored person is not in bed, it is assumed that the monitored person has woken up and is far from the local input unit, so the pre-alert warning is removed at 520 and the apparatus is reset by processor 112 at 512.

If the pre-alert is not a not-out-of-bed alert, and the current time is within the bedtime period, a check is made by processor 112 to determine whether the monitored person is in bed at 520. If the monitored person is in bed, he/she may be simply sleeping, so the pre-alert warning is removed and the system is reset by processor 112. If the monitored person is not in bed during the bedtime period, and unless he/she is in need of assistance, the monitored person should reach the local input unit within the grace time period. Thus, the method loops back to emitting the pre-alert warning.

Other events may also trigger a pre-alert. It is to be determined whether such events correspond to an actual emergency. This is done according to the chart of FIG. 11.

One such event is the connection of a sensor 102 to the apparatus 100 of the monitoring system. For example, if the sensor 102 includes a pressure pad, the pad is connected at all times for the unit to function correctly. However, it is known that pads have a usable lifetime before they need to be replaced, and that they may become inadvertently disconnected from apparatus 100 during use. Taking these facts into account, the apparatus 100 may continually monitor to determine if a pad is connected or not, regardless of whether pressure is applied on the pad.

Figure 11:
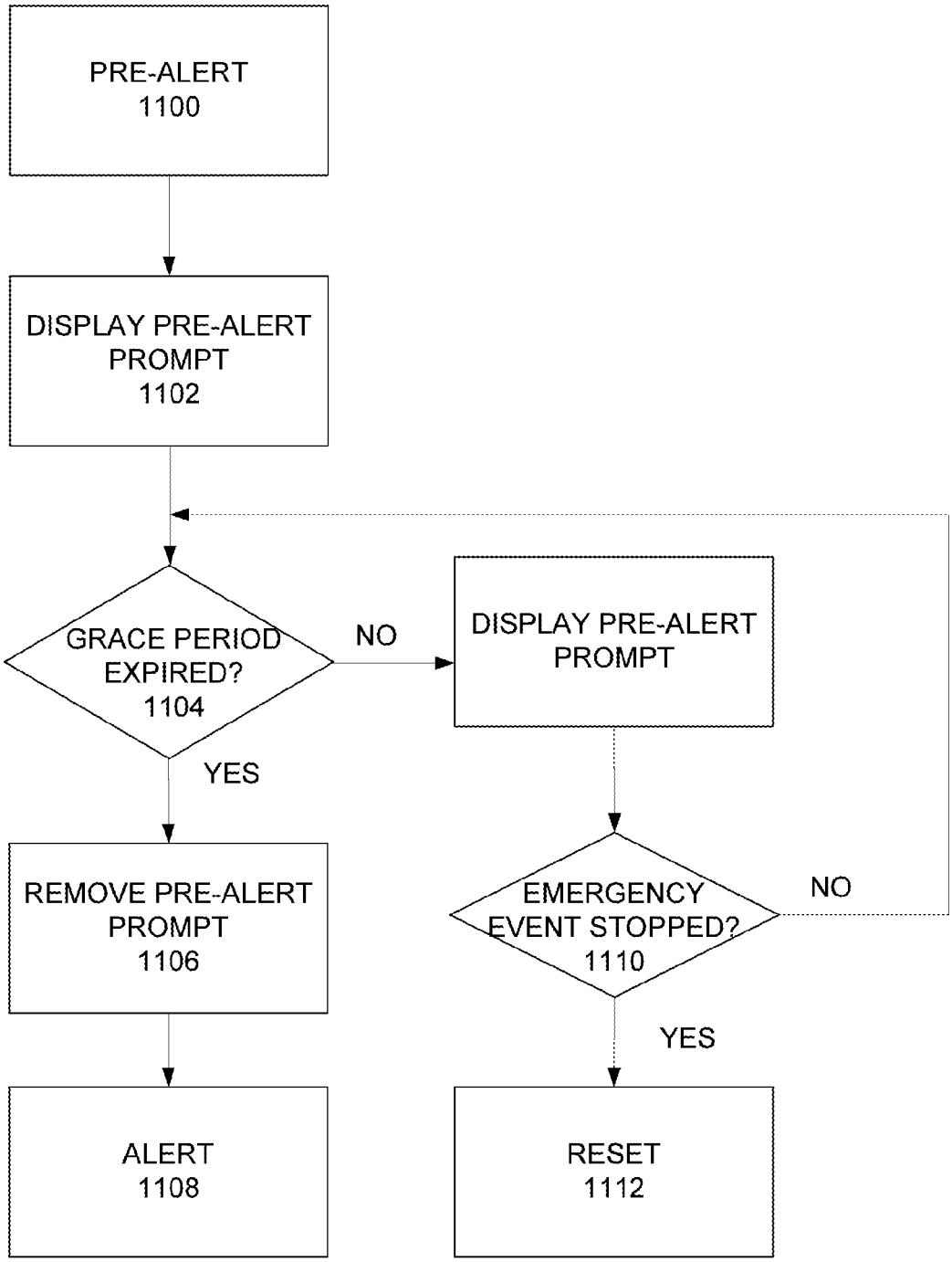
FIG. 11 is a flowchart illustrating a method for determining whether the pre-alert signal is indicative of an actual emergency, according to some embodiments of the present invention.

Referring now to FIG. 11, if processor 112 determines that a pad has become disconnected, processor 112 generates a pre-alert signal at 1100, and a warning is conveyed by local user interface 118 and/or local communication device 128 at 1102. If processor 112 determines that the pad has been disconnected for a predetermined amount of time (grace period) or longer (as seen in the check of 1104), the pre-alert warning is stopped/removed at 1106, and an alarm signal is generated by processor 112 at 1108. If the pad is reconnected/restored before the end of the grace period (as shown in the check of 1110), the system is reset by processor 112 at 1112. The grace period delay provides the monitored person or a helper of the monitored person with enough time to remove their current bed pad and replace it with a new one or to check the connection to apparatus 100 and/or the pad, without generating an alarm signal and worrying the caretakers.

Pressure pads used are manufactured to provide a specific product lifetime. Pads may be rated, for example, for 30 days, 6 months, 1 year, or 2 years. The lifetime is typically marked on the pad.

In some embodiments of the present invention, when a pad is connected, the processor 112 queries a user whether the pad is a new or old via local user interface 118 and/or local communication device 128. If the pad is new, processor 112 prompts the user to input the pad's time rating. Processor 112 stores this information, along with the current date, in memory 108, and may provide the user with a SMS message within a predetermined time period (e.g., 10 days, 30 days) prior to pad expiration, indicating that a new replacement pad should be ordered. Optionally, the apparatus sends out another notification, via local user interface 118 and/or local communication device 128, several days before the pad's actual expiration date to remind the user to install a new pad as soon as possible to ensure proper operation of the apparatus.

Figure 6:
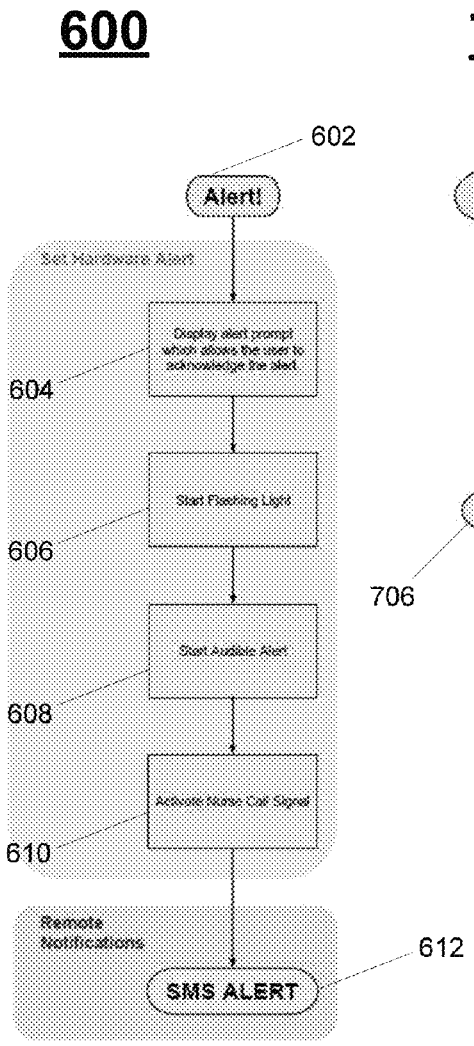
FIG. 6 is a flowchart illustrating a method for generating an alert warning, according to some embodiments of the present invention.

FIG. 6 is a flowchart 600 illustrating a method for generating an alert warning, according to some embodiments of the present invention;

If an alert signal is generated at 602 by processor 112, the alert signal is sent to the local output unit 124 via local linking unit 114, whereby the local output unit 124 generates an alert warning, such as an audible, visual, and/or tactile alert. Optionally, the alert warning may prompt the monitored person to acknowledge the warning, at 604. Optionally, a flashing light is activated at 606 and an audible alarm is activated at 608 in the local output unit 124. If the monitored person is in the care of a nurse, a nurse call signal may be activated at 610 to inform the nurse about the alert warning. A remote notification may be sent at 612 by apparatus 100 directly to the remote communication devices 122 of one or more responders, or to the remote system 120—which is to send the notifications to the remote communication devices. The remote system may generate an SMS, email, voice call, or data alert, by sending such notifications to one or more predefined phone numbers, IP addresses, email addresses, etc that are pre-stored in memory 108 and provided by apparatus 100, or pre-stored at remote system 120. In some embodiments of the present invention, if an alert signal is generated as a response to a power failure, the SMS, voice call, or data alert, is activated immediately without displaying the alert warning in the local output unit 124.

Figure 7:
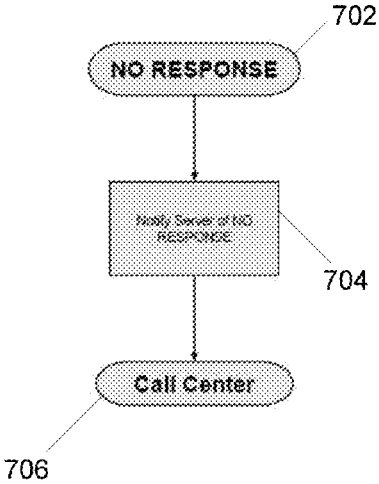
FIG. 7 is a flowchart illustrating a method for contacting a call center if a server is not responsive, according to some embodiments of the present invention.

FIG. 7 is a flowchart 700 illustrating a method for contacting a call center if a server is not responsive, according to some embodiments of the present invention.

If, following the SMS alert described above, the responders are not responsive at 702 (either via return SMS or by locally inputting an instruction directly in the monitoring system) and the monitored person still fails to acknowledge the alert warning, remote system 306 or 120 (e.g. server) is notified by apparatus 100/304 at 704 that the monitored person is not responsive, and the alert signal is sent to a call center at 706. Optionally, the call center is manned by human personnel. Alternatively, the call center is automated.

Figure 8:
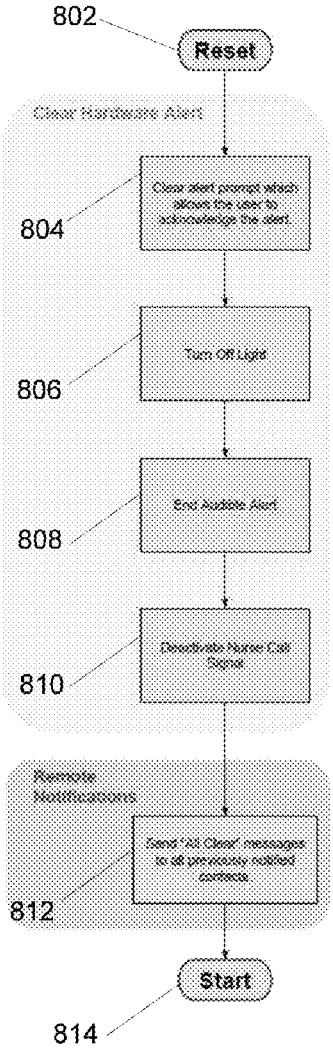
FIG. 8 is a flowchart illustrating a method for resetting a monitoring system/apparatus of the present invention, to inform previously contacted responders that the monitored person is being looked after, according to some embodiments of the present invention.

FIG. 8 is a flowchart illustrating a method for resetting a monitoring system/apparatus of the present invention, to inform previously contacted responders that the monitored person is being looked after, according to some embodiments of the present invention;

If a reset signal is generated at 802, for example, from local user interface 118 and/or local communication device 128, it is sent to the local output unit 124 to stop the local alert warning. Optionally, a warning prompting the monitored person to acknowledge the warning is removed from the display of the output unit 124 at 804. Optionally, the flashing light is deactivated at 806 and the audible alarm is deactivated at 808 in the local output unit 124. If the monitored person is in the care of a nurse, the nurse call signal is deactivated by processor 112 at 810. A remote reset notification may be sent to the remote communication devices 122, and/or to the remote system 120 at 812. The remote system 120 may generate a notification to notify responders that the alert has stopped, and send the notification to one or more predefined phone numbers, email addresses, IP addresses, etc.

Figure 9:
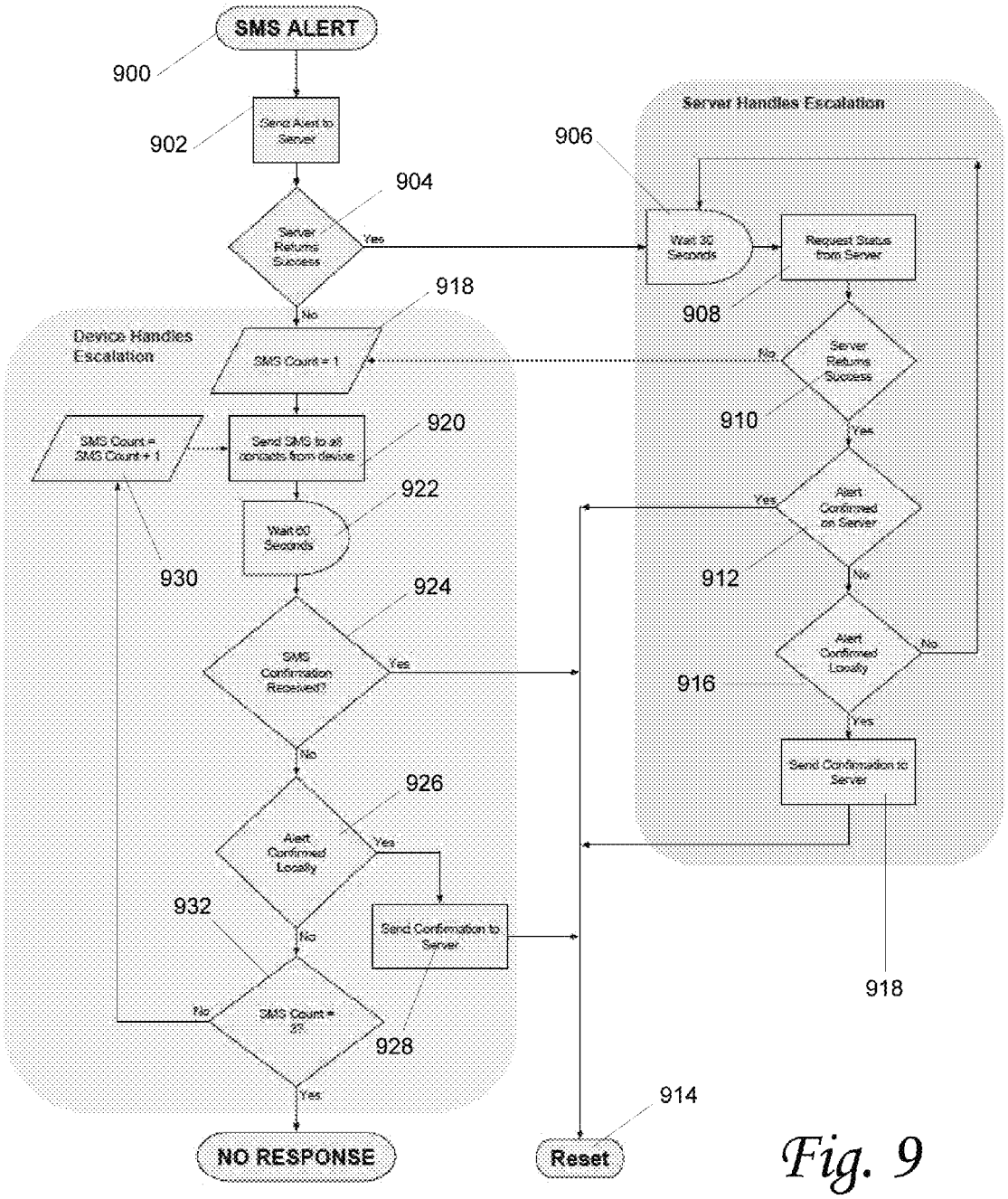
FIG. 9 is a flowchart illustrating a method for using an SMS generating system to informing one or more responders that the monitored person needs help, according to some embodiments of the present invention.

FIG. 9 is a flowchart illustrating a method for using an SMS generating system to informing one or more responders that a monitored person needs help, according to some embodiments of the present invention;

When an alert signal is generated at 900 by processor 112, the apparatus 100 of FIG. 1 (with or without the help of the remote system 120) attempts to send the alert signal to one or more remote communication devices associated with respective remote responders. For this purpose, two different paths of communication may be attempted for redundancy.

At 902 the alert signal is handed off to an internet server (remote system 120) which has the ability to send and receive SMS messages and act accordingly. If the server 120 accepts the alert signal, the local apparatus 100 or 304 simply queries the server 120 for updates. More specifically, the local apparatus checks if the communication with the server is successful (server returns success) at 904. If so, after a predetermined time interval (e.g., 10, 20, 30 seconds) shown in 906, the local apparatus requests an update from the server at 908 and checks if communication with the server is successful (server returns success) at 910. If the communication is successful, the server sends SMS's to caretakers/responders/other interested parties such as friends or family, and checks at 912 whether at least one of the caretakers/responders/other interested parties has acknowledged the SMS (alert confirmed on server). If at least one responder has acknowledged the SMS, the apparatus 100 is reset at 904. If none of the responders acknowledges the SMS, a check is made at 916 by server 120 to determine if the alert is confirmed locally at the apparatus 100. If the alert was generated in response corresponds to a probable need of assistance of the monitored person, the alert is confirmed locally when the monitored person or a caretaker has reached the input unit of the monitoring system and instructed the alert to stop. If the alert was generated in response to a power outage, the alert is confirmed locally when power is restored. If the alert is confirmed locally, the confirmation of the local acknowledgment is sent to the server at 918 by the apparatus 100, the server 120 stops contacting the responders, and the apparatus 100 is reset at 914. If the server fails to send SMS's and the alert signal is not confirmed locally, the process loops to step 906 in which apparatus 100 waits a predetermined time interval before contacting the server 120 again.

In some embodiments of the present invention, the connection between the apparatus 100 and the server 120 is effected via a cellular data connection.

Optionally, the apparatus 100 includes a transmission device (e.g. modem, cellular ASIC, Wi-Fi transceiver, etc.) configured for sending notifications directly to responders' remote communication devices without having to rely on the server 120. In this embodiment, if communication between apparatus 100 and the server 120 fails at any time (e.g. the server(s) is (are) down or cellular data service is disrupted at the location of the monitored person), the local apparatus 100 handles the sending of notifications. To do this, in one embodiment, the local apparatus 100 sets a count value to 1 at 918, sends SMS notifications to all responders at 920, waits a predetermined time interval (e.g., 30, 60, 120 seconds) at 922, and checks whether any of the SMS's were acknowledged at 924. If at least one SMS is acknowledged, the system is reset at 914. In no SMS's are acknowledged, a check is performed to determine whether the alert was confirmed locally at 926. If the alert is confirmed locally, the confirmation is sent to the server at 928 and the apparatus 100 is reset at 914.

If no SMS's are acknowledged, and the alert is not confirmed locally, the system generates a "no response" warning. Optionally, before the "no response" warning, the local apparatus 100 adds 1 to the SMS count value at 930, loops to the sending of the SMS and performs the subsequent steps, as described above. If this loop has occurred a predetermined number of times, and the SMS count value is equal to a predetermined value (e.g., 2, 3, 5) at the check 932, the local apparatus 100 generates a "no response" signal. Optionally, the "no response" signal causes the local apparatus 100 to contact a call center in order to attempt contacting at least one responder, as shown in FIG. 7.

Figure 10:
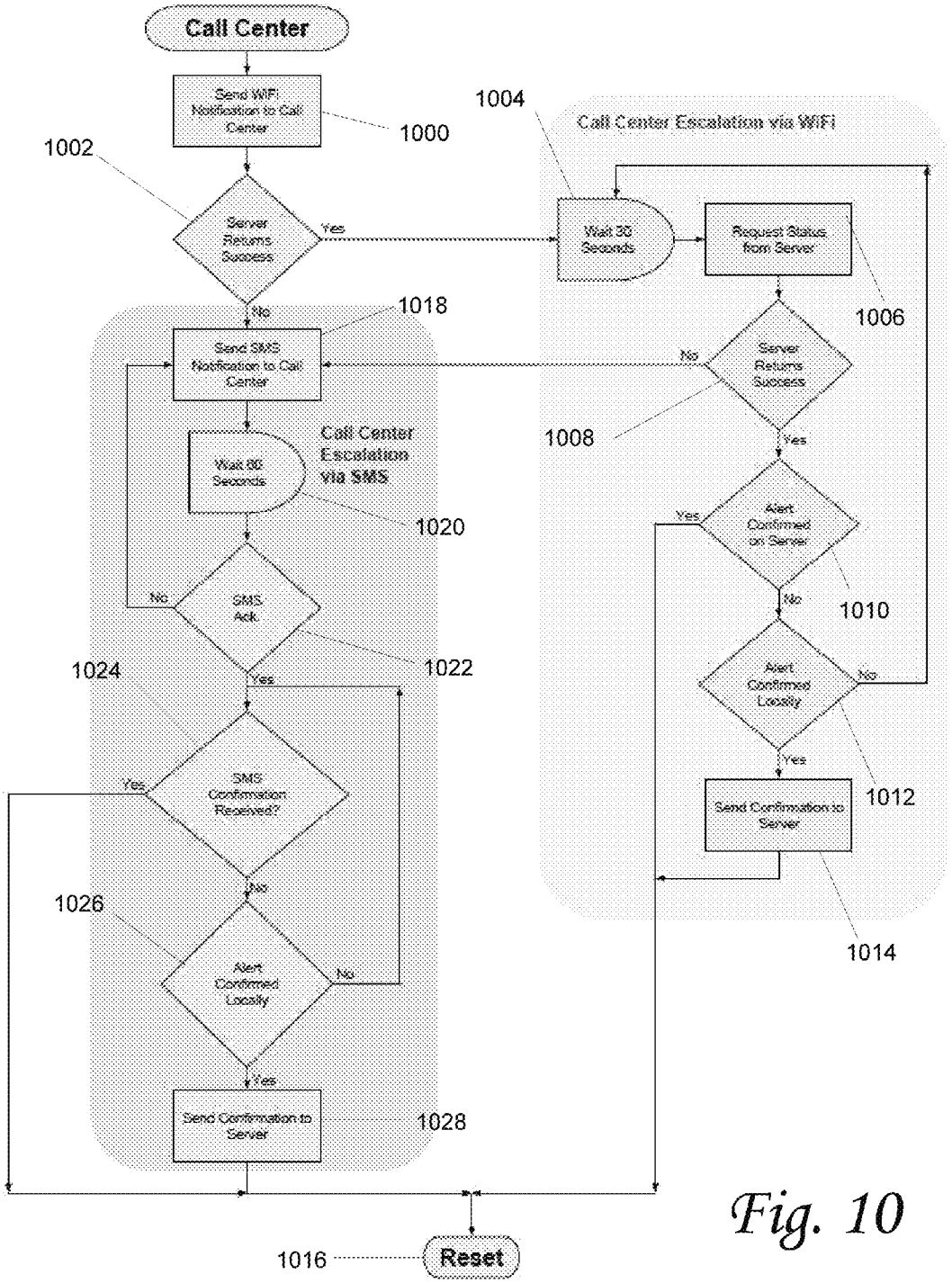
FIG. 10 is a flowchart illustrating a method for using a call center to inform one or more caregivers that the monitored person needs help, according to some embodiments of the present invention.

FIG. 10 is a flowchart illustrating a method for using a call center to inform one or more caregivers that a monitored person needs help, according to some embodiments of the present invention; and Optionally, the method of FIG. 10 follows the method of FIG. 9 if a "no response" warning is generated. A notification to a call center is sent via a server at 1000. If communication with the server is successful at the check of 1002, the server contacts the call center, keeps contacting the call center to receive a confirmation that at least one SMS has been acknowledged, and keeps contacting the apparatus 100 to receive a confirmation that the emergency condition has been confirmed locally, until one of these conditions is fulfilled (steps 1004-1014). If one of these conditions is fulfilled, the server 120 is reset at 1016.

If any time, communication between the server and the call center is interrupted at the check of 1008, the local apparatus 100 itself attempts contacting the call center. First, the local apparatus 100 instructs the call center to send SMS notifications to the responders at 1018, and waits for a predetermined time interval at 1020, to receive a notification from the call center that the SMS notifications have been sent at 1022. If the SMS notifications have not been sent, e.g., the predetermined time interval expires without receiving an acknowledgement from the call center, the process loops to the step 1018 of instructing the call center. If the SMS notification have been sent, the apparatus 100 contacts the call center to determine whether any of the SMS notifications have been acknowledged by the caregivers at 1024. If at least one SMS notification has been acknowledged by a caregiver, apparatus 100 receives an indication of such from the call center, and the apparatus 100 is reset at 1016. If none of the notifications is acknowledged, the local apparatus checks whether the alert has been confirmed locally at 1026. If this is the case, the server is informed of the local confirmation at 1028 and the monitoring system is reset. Otherwise, the process loops back to checking whether any SMS has been acknowledges.

In one embodiment, the process of FIG. 10 will not stop until at least one of the SMS notifications has been acknowledged by a responder or the alert is acknowledged (confirmed) locally at the local apparatus 100. As mentioned above, the call center may be manned by human personnel or may be automatic. In one, non-limiting example, the call center uses a voice API system. The voice API system places a call to a responder and reads, using text-to-voice software, a message which alerts the responder as to the active alert and its severity. Optionally, the voice API system interacts with the caregiver by providing caregiver with a menu of options. One of the options may involve pressing a predetermined button on the phone to reply to the call center's message. The API system may be used instead of the sending SMS messages, or as an additional option, used for example as a "last resort" contact method after several rounds of text messages have been sent with no response.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An apparatus for monitoring a person, comprising:

a sensor port configured for receiving first signals from a sensor associated with a bed of the person;

a memory unit for storing machine-readable instructions and a set of parameters used to determine one or more alert conditions related to the person's use of the bed;

a timer configured for measuring time;

a processor, coupled to the sensor port, to the timer, and to the memory, for executing the machine-readable instructions that causes the apparatus to:

receive the first signals from the sensor via the sensor port and determine therefrom whether the person is in the bed or not in the bed;

determine time instances and time durations associated with the person being in the bed and being out of the bed based on the first signals and on time measurements by the timer;

compare the time instances and time durations to at least some of the parameters in the set of parameters to determine whether an alert condition of the one or more alert conditions has occurred;

generate an alert alarm signal if the alert condition has occurred; and cancelling the alert alarm signal, in response to a cancel instruction;

a local linking unit configured for connecting to a local user interface, and communicating with a local user interface, such that the local user interface is configured for configured to receiving the alert signal and for conveying a local alarm warning in proximity to the local user interface, and for receiving a cancel instruction from one or more of the persons proximate to the apparatus to cancel the alert signal; and a remote linking unit configured for connecting to a remote system configured for receiving the alert signal and conveying a remote alarm alert to one or more remote communication devices associated with respective responders located remotely from the apparatus, and for receiving a first cancel instruction conveyed from the one or more responders to cancel the alert signal.

2. The apparatus of claim 1, wherein:

prior to generating the alert alarm signal, the processor is configured for causing the apparatus to generate a pre-alert alarm signal if the alert condition has occurred, the pre-alert alarm signal for notifying the persons proximate to the apparatus that an alert condition has occurred;

the local linking unit is further configured for receiving the pre-alert alarm signal and for conveying a pre-alert alarm in proximity to the local user interface, and for receiving a second cancel instruction conveyed from one of the persons proximate to the apparatus to cancel the pre-alert alarm;

the processor is configured for cancelling the pre-alert alarm, in response to receiving the second cancel instruction; and the processor is configured for causing the apparatus to generate the alert signal only if the alert condition persists for a predetermined time period without being cancelled.

3. The apparatus of claim 1, further comprising a transmitter coupled to the processor, configured to transmit the alert alarm signal to a local communication device physically separated from the apparatus and located within a space associated with the monitored person, causing the local communication device to convey the local alarm warning to persons located proximate to the local communication device to notify that one of the alert conditions has occurred.

4. The apparatus of claim 2, further comprising a transmitter configured to transmit the pre-alert alarm signal to a local communication device, causing the local communication device to convey the pre-alert alarm to persons located proximate to the local communication device to notify that one of the alert conditions has occurred;

wherein the transmitter is configured for conveying the alert alarm signal to the local communication device only if the pre-alert alarm signal has not been cancelled within the predetermined time period.

5. The apparatus of claim 3, further comprising a receiver configured to receive a cancellation signal from the local communication device for the apparatus to cancel the alert alarm signal;

wherein the processor is configured for cancelling the alert alarm signal upon reception of the cancellation signal.

6. The apparatus of claim 4, further comprising a receiver configured to receive a cancellation signal from the local communication device for the apparatus to cancel the alert alarm signal and/or the pre-alert alarm signal;

wherein the processor is configured for cancelling the alert alarm signal and/or the pre-alert signal upon reception of the cancellation signal.

7. The apparatus of claim 1, wherein the one or more alert conditions comprise at least one of the following:

the person is out of bed during a bedtime period specified in the set of parameters;

the person is in bed after a wake-up time specified in the set of parameters; and the person has been out of bed during the bedtime period for a time interval greater than a predetermined time interval specified in the set of parameters.

8. The apparatus of claim 4, wherein the machine-readable instructions further comprise instructions that cause the apparatus to:

generate a notification for transmission to the remote system, in response to receiving the cancel instruction, the notification for informing the remote system that the pre-alert alarm had been generated and then canceled; and the remote linking unit is further configured to transmit the notification.

9. The apparatus of claim 1, wherein the remote system comprises at least one of a monitored call center and a server.

10. The apparatus of claim 1, comprising the local user interface, such that the local user interface is integral with the apparatus.

11. A kit for monitoring a person, comprising the apparatus of claim 10 and the sensor.

12. A kit for monitoring a person, comprising the apparatus of claim 1 and the sensor.

13. A system for monitoring a person and configured for operating in conjunction with a timer and a memory module configured for storing first data indicative of commands for an operation of the system, the system comprising:

i. an analysis module, configured for:

i(a). receiving second data from at least one sensor associated with the person's bed;

i(b). processing the second data to determine a status relating to presence of the person in bed and/or an absence of the person from the bed, and to a time length of the person's presence and/or absence;

i(c). using the first data and time from the timer to identify at least one undesirable condition relating to the status;

i(d). if the at least one condition is true, generating a first control signal;

ii. an alert module, configured for:

ii(a). receiving the first control signal;

ii(b). responsive to the first control signal, generating an alert signal;

ii(c). transmitting the alert signal to a local device associated with the person, for causing the local device to convey an alert warning to the person;

ii(d). transmitting the alert signal to a remote system, configured for contacting at least one caretaker of the person and conveying the alert warning to the at least one caretaker;

iii. a reset module, in communication with the local device and with the remote system, the reset module being configured for:

iii(a). receiving a reset signal from the local device and/or from the remote system;

iii(b). responsive to the reset signal, sending a third control signal to the alert module;

wherein, the alert module is configured for receiving the reset signal and, in response to the alert signal, for instructing the local device to stop conveying the alert warning and the system device to stop contacting the at least one caretaker;

iv. a pre-alert module configured for:

preventing the first control signal to reach the alert module;

receiving the first control signal;

upon reception of the first control signal, generating a pre-alert signal for causing a local device associated with the person to convey a pre-alert warning to the person;

using the first data and the time from the timer to determine whether the pre-alert warning has been active for a time length greater than a grace period specified in the first data; and generating a second control signal, if the pre-alert warning has been active for a time length greater than the grace period;

wherein the alert module is further configured for receiving the second control signal and for generating the alert signal in response to the second control signal.

14. The system of claim 13, wherein the pre-alert module is configured for receiving the reset signal from the reset module and, in response to the reset signal, for instructing the local device to stop conveying the pre-alert warning or the alert warning.

15. A system for monitoring a person and configured for operating in conjunction with a timer and a memory module configured for storing first data indicative of commands for an operation of the system, the system comprising:

i. an analysis module, configured for:

i(a). receiving second data from at least one sensor associated with the person's bed;

i(b). processing the second data to determine a status relating to presence of the person in bed and/or an absence of the person from the bed, and to a time length of the person's presence and/or absence;

i(c). using the first data and time from the timer to identify at least one undesirable condition relating to the status;

i(d). if the at least one condition is true, generating a first control signal;

ii. an alert module, configured for:

ii(a). receiving the first control signal;

ii(b). responsive to the first control signal, generating an alert signal;

ii(c). transmitting the alert signal to a local device associated with the person, for causing the local device to convey an alert warning to the person;

ii(d). transmitting the alert signal to a remote system, configured for contacting at least one caretaker of the person and conveying the alert warning to the at least one caretaker;

iii. a reset module, in communication with the local device and with the remote system, the reset module being configured for:

iii(a). receiving a reset signal from the local device and/or from the remote system;

iii(b). responsive to the reset signal, sending a third control signal to the alert module;

wherein, the alert module is configured for receiving the reset signal and, in response to the alert signal, for instructing the local device to stop conveying the alert warning and the system device to stop contacting the at least one caretaker;

wherein:

upon receipt of the alert signal, the alert module is further configured for checking a connection between the alert module and the remote system;

if the connection is successful, generating and transmitting the alert signal to the remote system;

if the connection is not successful, transmitting an instruction signal to the local device to cause the local device to contact the at least one caretaker and conveying the alert warning to the at least one caretaker.

16. The system of claim 15, wherein if the connection is not successful:

upon receipt of the reset signal, the alert module is configured for instructing the local device to stop conveying the alert warning and to stop contacting the at least one caretaker.

17. The system of claim 15, wherein, responsive to the reset signal, the alert module is configured for instructing the local device to contact the at least one caretaker and to inform the caretaker that the alert signal has ceased.

18. A system for monitoring a person, the system comprising a local apparatus and a remote apparatus, wherein:

i. the local apparatus is configured for:

i(a). receiving data from at least one sensor associated with the person's bed, and for using the data to identify at least one undesirable condition relating to a presence of the person on the bed and/or an absence of the person from the bed;

i(b). upon identification of the at least one undesirable condition, outputting an alert warning and prompting locally for an input, and generating an alert signal;

i(c). checking a connection with the remote apparatus;

i(d). if the connection with the remote apparatus is successful, transmitting an alert signal to the remote apparatus;

i(e). if the connection with the apparatus is not successful, transmitting the alert signal to at least one remote communication device associated with a respective predetermined responder;

ii. the remote apparatus is configured for:

ii(a). receiving the alert signal;

ii(b). upon reception of the alert signal, transmitting the alert signal to at least one remote communication device associated with a respective predetermined responder;

wherein after the identifying the at least one undesirable condition and prior to the generating of the alert warning, the local apparatus is configured for:

outputting a pre-alert warning and prompting locally for an input; and if the input is not received within a predetermined length of time, outputting the alert warning and generating the alert signal.

19. The system of claim 18, wherein:

if the local apparatus receives a local input, following the pre-alert warning, the local device is configured for stopping the output of the pre-alert warning.

20. A system for monitoring a person, the system comprising a local apparatus and a remote apparatus, wherein:

i. the local apparatus is configured for:

i(a). receiving data from at least one sensor associated with the person's bed, and for using the data to identify at least one undesirable condition relating to a presence of the person on the bed and/or an absence of the person from the bed;

i(b). upon identification of the at least one undesirable condition, outputting an alert warning and prompting locally for an input, and generating an alert signal;

i(c). checking a connection with the remote apparatus;

i(d). if the connection with the remote apparatus is successful, transmitting an alert signal to the remote apparatus;

i(e). if the connection with the apparatus is not successful, transmitting the alert signal to at least one remote communication device associated with a respective predetermined responder;

ii. the remote apparatus is configured for:

ii(a). receiving the alert signal;

ii(b). upon reception of the alert signal, transmitting the alert signal to at least one remote communication device associated with a respective predetermined responder;

wherein:

following the transmittal of the alert signal, the remote apparatus is configured for receiving an acknowledgement from the at least one remote communication device, and in response to the acknowledgement, the remote apparatus is configured for ceasing generation and transmittal of the alert signal and for generating and sending a reset signal to the local apparatus; and upon receipt of the reset signal, the local apparatus is configured for stopping the output of the alert warning.

21. A system for monitoring a person, the system comprising a local apparatus and a remote apparatus, wherein:

i. the local apparatus is configured for:

i(a). receiving data from at least one sensor associated with the person's bed, and for using the data to identify at least one undesirable condition relating to a presence of the person on the bed and/or an absence of the person from the bed;

i(b). upon identification of the at least one undesirable condition, outputting an alert warning and prompting locally for an input, and generating an alert signal;

i(c). checking a connection with the remote apparatus;

i(d). if the connection with the remote apparatus is successful, transmitting an alert signal to the remote apparatus;

i(e). if the connection with the apparatus is not successful, transmitting the alert signal to at least one remote communication device associated with a respective predetermined responder;

ii. the remote apparatus is configured for:

ii(a). receiving the alert signal;

ii(b). upon reception of the alert signal, transmitting the alert signal to at least one remote communication device associated with a respective predetermined responder;

wherein:

following transmittal of the alert signal by the local apparatus, the local apparatus is configured for receiving an acknowledgement from the at least one remote communication device, and in response to the acknowledgement, the local apparatus is configured for ceasing generation and transmittal of the alert signal to the at least one remote communication device.

* * * * *